US007714717B2

(12) United States Patent
Hsu

(10) Patent No.: US 7,714,717 B2
(45) Date of Patent: May 11, 2010

(54) DOOR ALARM SYSTEM

(76) Inventor: Chih-Hung Hsu, 12F-3, No. 267, Gongguan Rd., West Dist., Taichung (TW)

( * ) Notice: Subject to any disclaimer, the term of this patent is extended or adjusted under 35 U.S.C. 154(b) by 267 days.

(21) Appl. No.: 12/068,387

(22) Filed: Feb. 6, 2008

(65) Prior Publication Data

US 2009/0195383 A1 Aug. 6, 2009

(51) Int. Cl.
*G08B 13/08* (2006.01)

(52) U.S. Cl. ..... 340/545.1; 340/636.1; 340/5.71

(58) Field of Classification Search ..... 340/545.1, 340/549, 545.6, 545.7, 545.8, 545.9, 571, 340/636.1, 825.24, 5.71
See application file for complete search history.

(56) References Cited

U.S. PATENT DOCUMENTS 4,194,193 A * 3/1980 McDonough ..... 340/549
4,808,974 A * 2/1989 Cantley ..... 340/546
6,519,811 B1 * 2/2003 Cheng ..... 16/252
7,107,723 B2 * 9/2006 Chiang ..... 49/388
7,151,463 B2 * 12/2006 Hsu ..... 340/693.5

* cited by examiner

*Primary Examiner*—Daniel Previl
(74) *Attorney, Agent, or Firm*—Bacon & Thomas, PLLC

(57) ABSTRACT

A door alarm system comprises a door having a doorframe, a door body and a door alarm device mounted in the doorframe or door body. The door alarm device comprises a housing, a cover mounted on the housing and having a rear surface, a push button hole and four guideposts formed on and protruding from the rear surface, a battery compartment, a push button and a controller. The push button is mounted slidably in and protrudes from the push button hole and has a cap with a neck, an electrical pad mounted on the guideposts and having a through hole, a metallic plug and a resilient member. The metallic plug is mounted through the through hole in the electrical pad, connects to the neck and selectively makes contact with the electrical pad when the door is open. The controller mounted in the housing and provides an audible warning when the door body is open.

8 Claims, 8 Drawing Sheets

DOOR ALARM SYSTEM

BACKGROUND OF THE INVENTION

1. Field of the Invention

The present invention relates to a door alarm system, and more particularly to a door alarm system that produces an audible warning when the door is open.

2. Description of Related Art

In recent years, various home security systems have become necessary because of the increase in burglary, home invasion and the like. Home security systems may be as simple as a deadbolt or sophisticated electronic surveillance systems with motion detectors, pressure detectors and the like. However, all of these systems have a common shortcoming. They must be activated and deactivated by an occupant to be effective. If the occupant forgets to activate the system, i.e. lock the deadbolt, activate the surveillance system or the like, the home security system is completely useless.

To overcome the shortcomings, the present invention provides a door alarm system to obviate or mitigate the aforementioned problems.

SUMMARY OF THE INVENTION

The main objective of the invention is to provide a door alarm system that provides an audible warning when the door is open.

To accomplish the foregoing objective, the door alarm system in accordance with the present invention comprises a doorframe, a door body and a door alarm device mounted in the doorframe or the door body. The door alarm device comprises a housing, a cover, a battery compartment, a push button and a controller. The housing is mounted in the recess and has an open front. The cover is mounted on and closes the open front of the housing flush with the doorframe and has a rear surface, two ends, a battery compartment, hole a push button hole and four guideposts. The battery compartment hole is formed near one end. The push button hole is formed near the other end. The guideposts are formed on and protrude from the rear surface of the cover around the push button hole. The battery compartment is mounted on the rear surface, corresponds to the battery compartment hole and has a battery compartment cover mounted in the battery compartment hole flush with the cover. The push button is mounted slidably in and protrudes from the push button hole and has a cap, an electrical pad, a metallic plug and a resilient member. The cap has a neck and two tabs protruding from an inner surface. The electrical pad is mounted on the guideposts and has a through hole. The metallic plug is mounted through the through hole in the electrical pad, connects to the neck and selectively makes contact with the electrical pad when the door body is open. The controller mounted in the housing and provides an audible warning. The power source is electrically connected to the controller to supply electricity to the door alarm device.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1, 2, 4 and 5, a door alarm system in accordance with the present invention comprises a door and an alarm device (20) mounted on the door.

Figure 1:
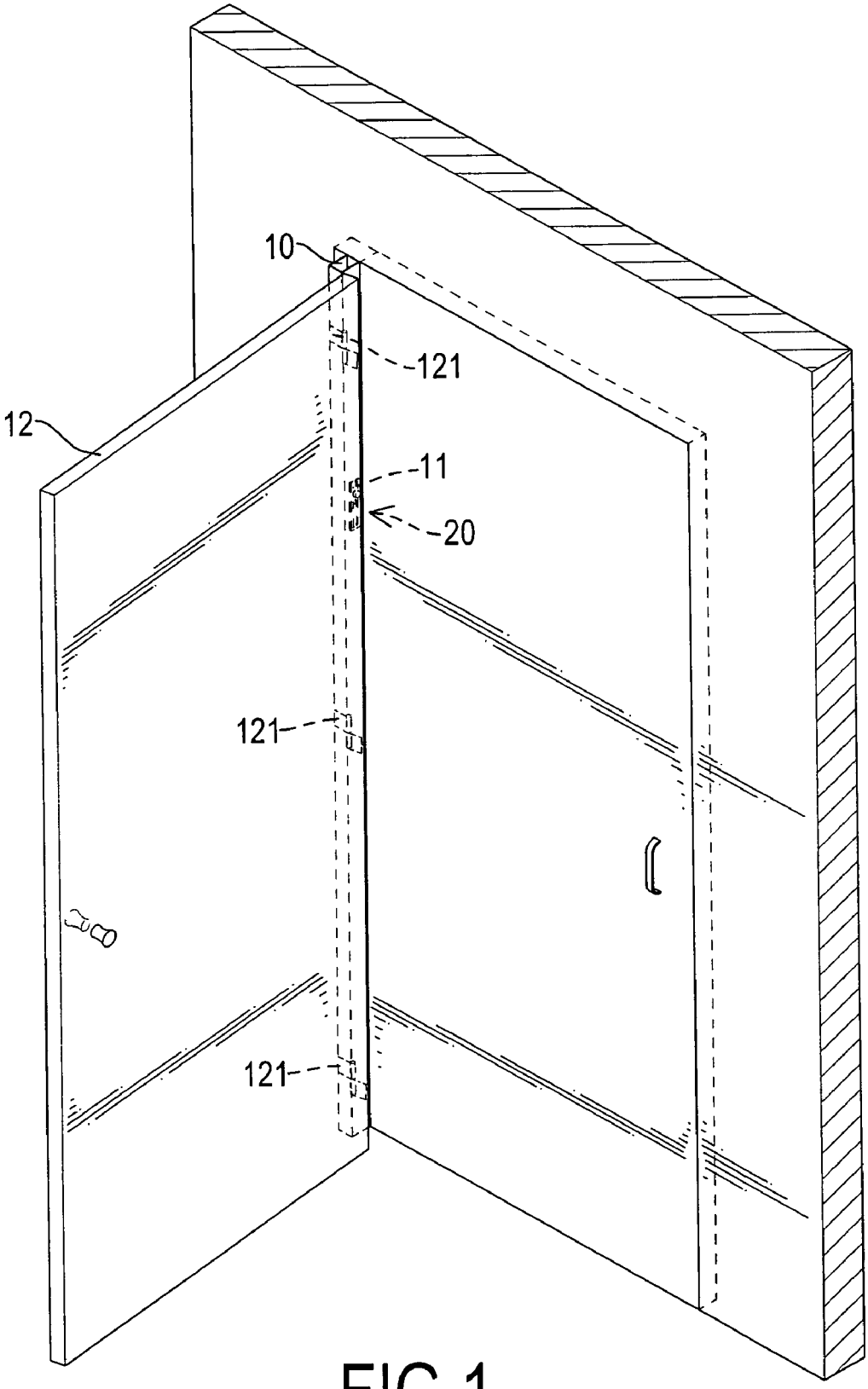
FIG. 1 is a perspective view of a first embodiment of a door alarm system in accordance with the present invention.
Figure 2:
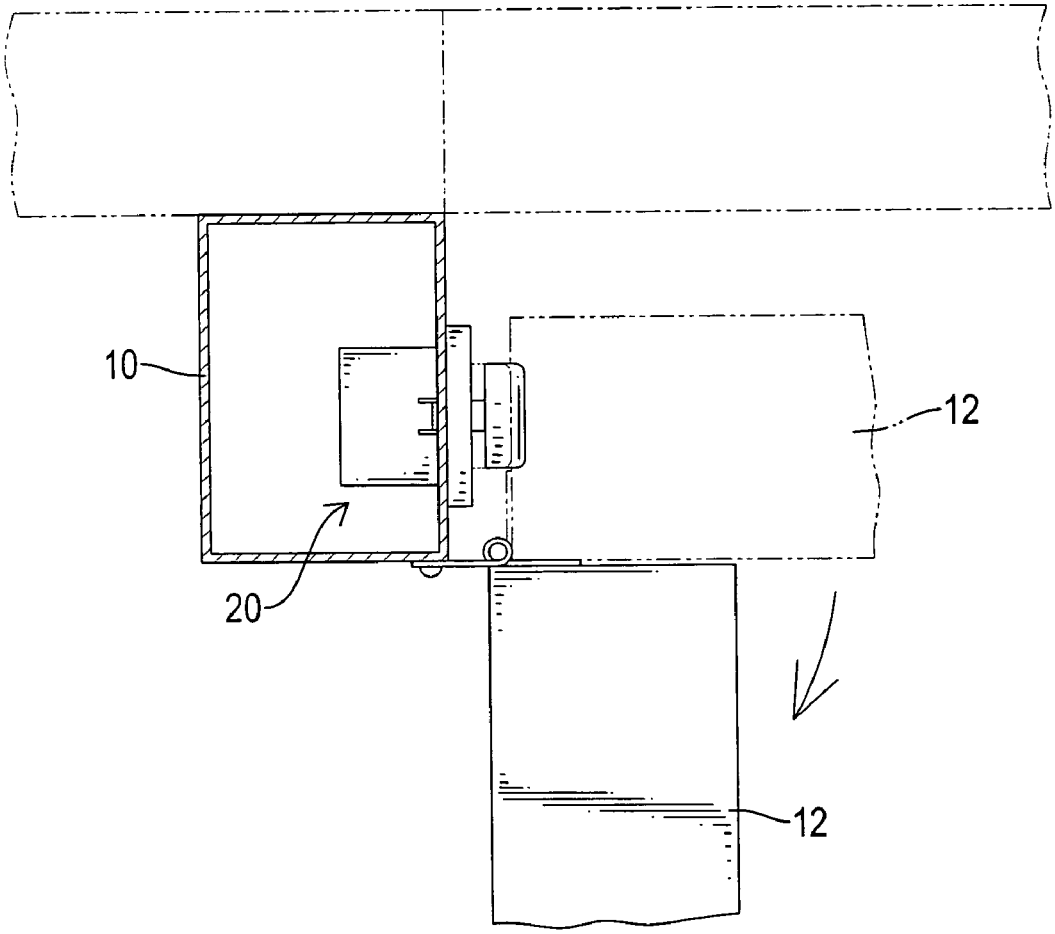
FIG. 2 is a top view in partial section of the door alarm system in FIG. 1.
Figure 3:
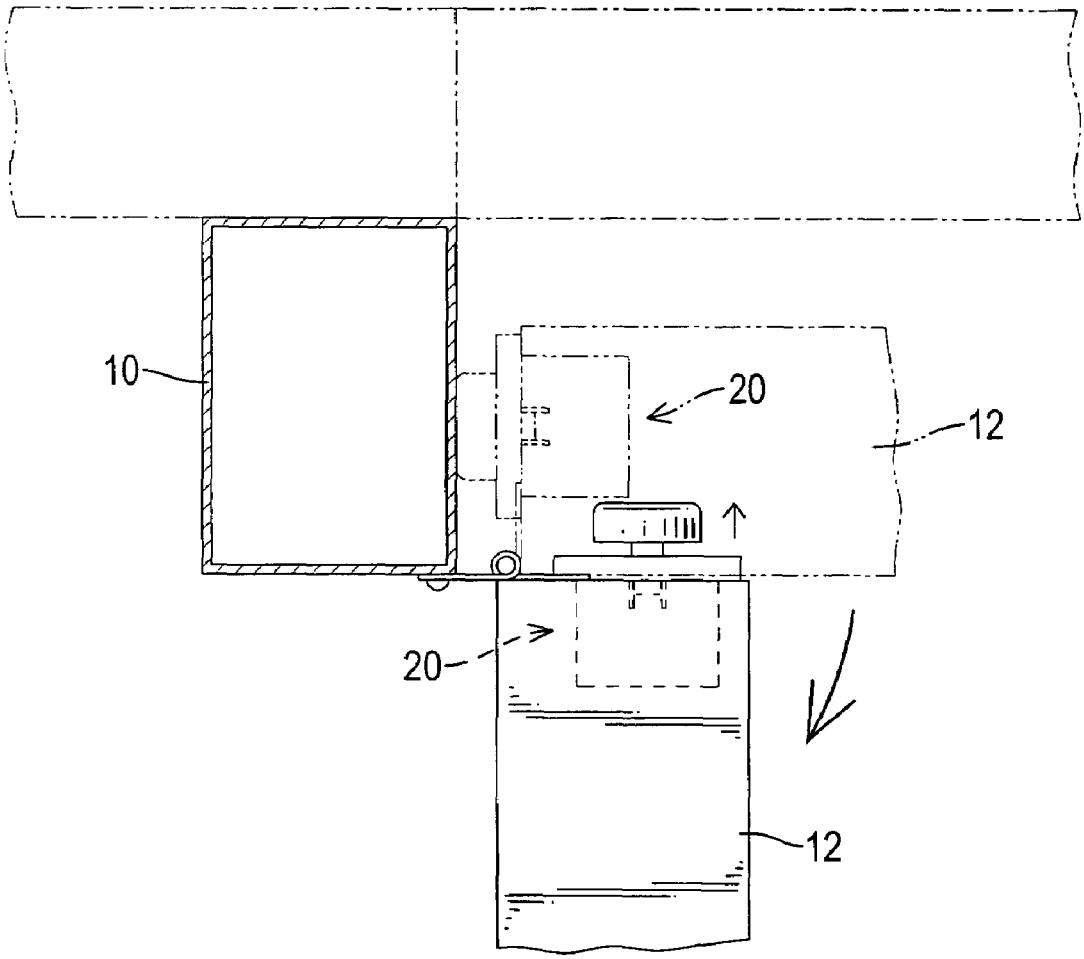
FIG. 3 is a top view in partial section of a second embodiment of a door alarm system.
Figure 4:
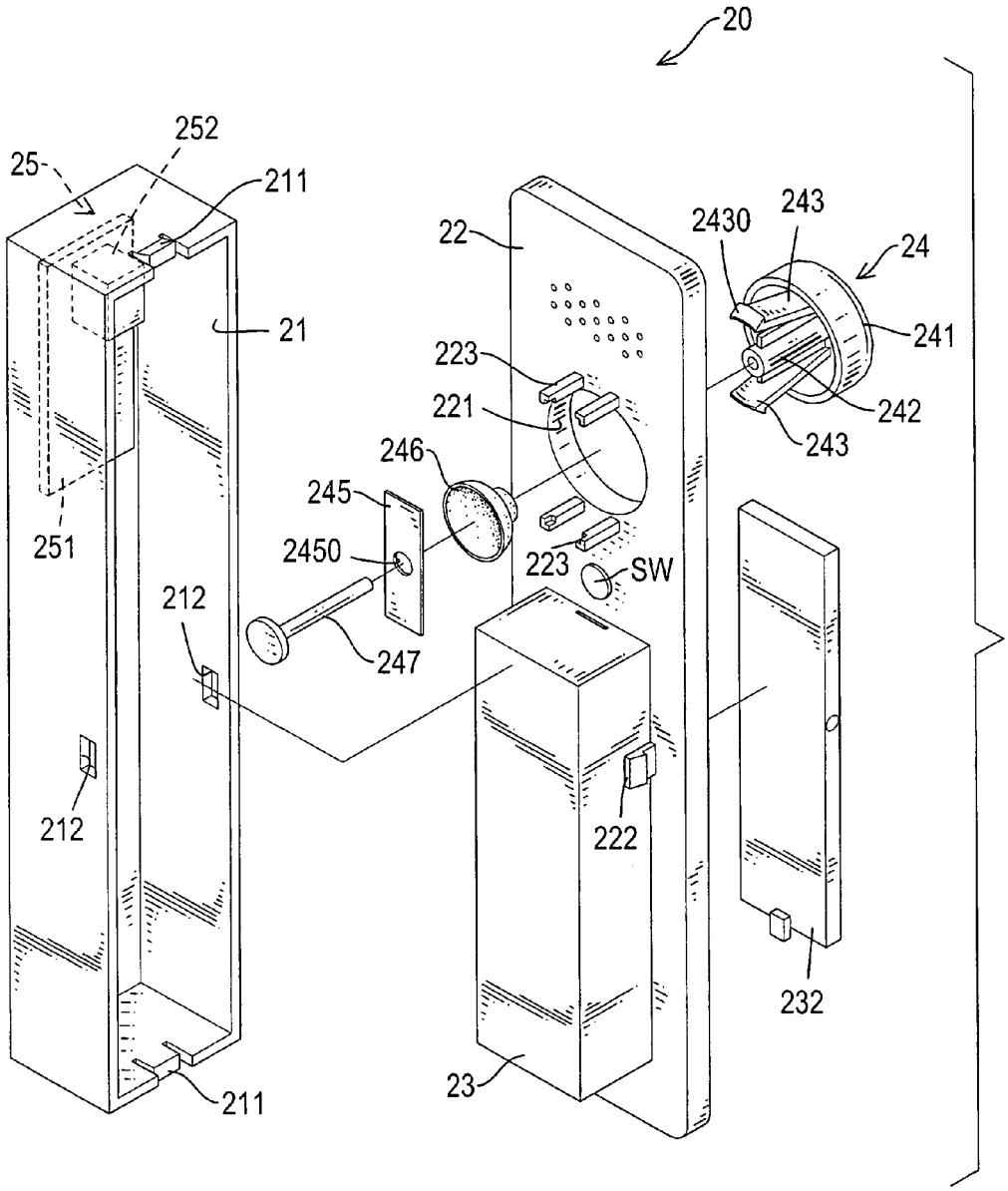
FIG. 4 is an exploded perspective view of a door alarm device in FIG. 1.
Figure 5:
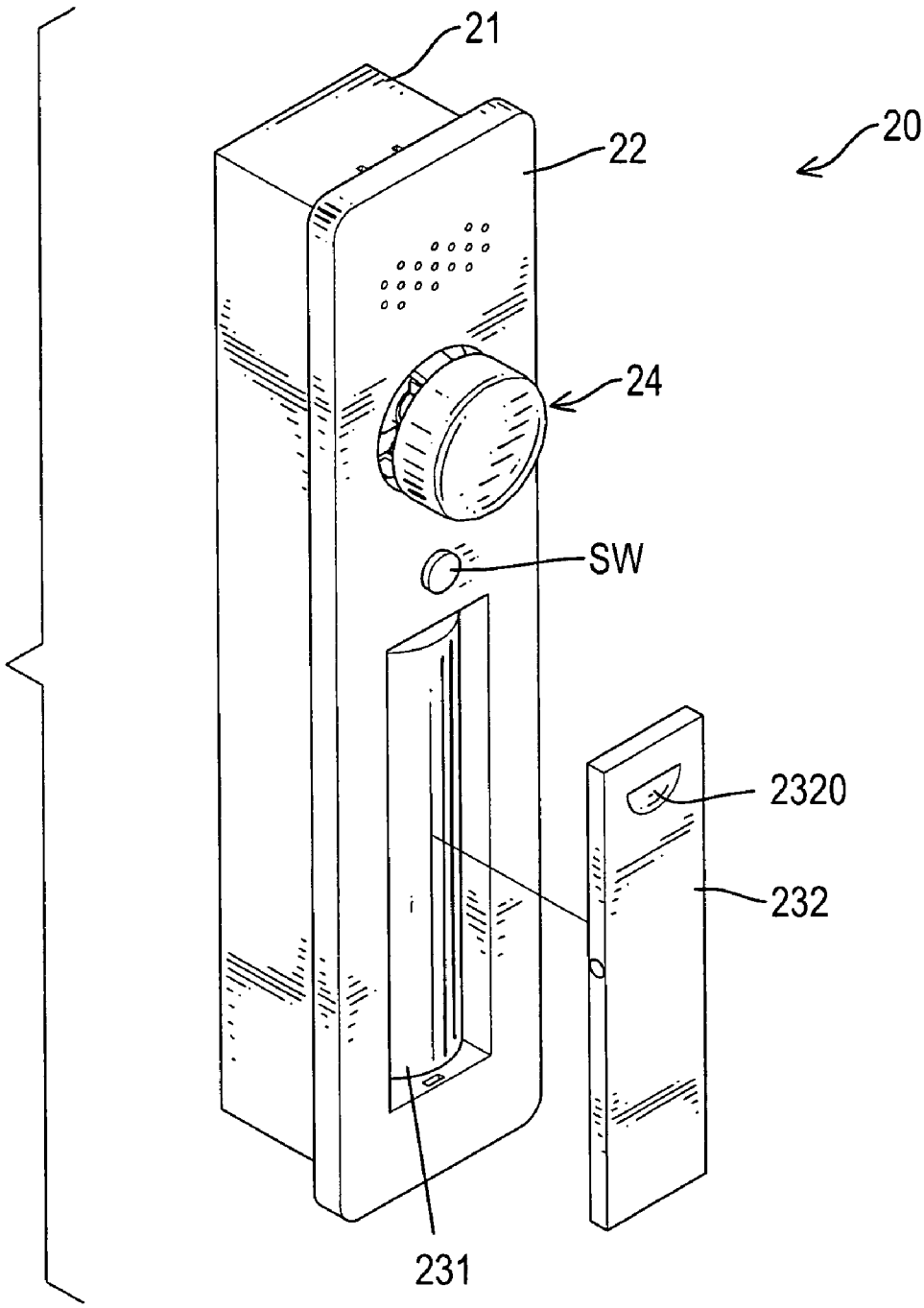
FIG. 5 is an exploded perspective view in partial of the door alarm device in FIG. 1.

The door has a doorframe (10), a door body (12) and a recess (11). The recess (11) may be defined in the doorframe (10) or door body (12), so the alarm device (20) can be mounted in the recess (1) of the doorframe (10) or the door body (12), with further reference to FIG. 3. The door body (12) is mounted pivotally in the doorframe (10) and has a proximal edge and at least one hinge. The proximal edge is attached pivotally to the doorframe (10). The at least one hinge is attached to the proximal edge of the door body (12) and the doorframe (10). In first embodiment, the recess (11) is formed in the doorframe (10) adjacent to the proximal edge of the door body (12) and has an upper and lower edge. With further reference to FIG. 3, in a second embodiment, the recess (11) is formed in the door body (12) adjacent to the doorframe (10) and also has an upper and lower edge.

In this preferred embodiment, the door alarm device (20) is mounted in the recess (11) of the doorframe (10) and comprises a housing (21), a cover (22), a battery compartment (23), a push button (24) and a controller (25).

The housing (21) is mounted in the recess (11) and has a top, a bottom, an upper edge, a lower edge, two sides, an open front, two clamps (211) and two notches (212).

The clamps (211) are formed respectively on the upper edge and the lower edge of the housing (21), protrude out respectively from the top and bottom and hook respectively on the upper and lower edges of the recess (11) in the doorframe (10) to hold the door alarm device (20) in the doorframe (10).

The notches (212) are formed respectively on the two sides of the housing (21).

The cover (22) is mounted detachedly on and closes the open front of the housing (21) flush with the doorframe (10) and has two ends, a rear surface, two sides, a push button hole (221), four guideposts (223), a battery compartment hole and two latches (222).

The push button hole (221) is formed through the cover (22) near one end of the cover (22) and has an edge (not numbered).

The guideposts (223) are formed on and protrude from the rear surface of the cover at the edge of the push button hole (221) of the cover (22), and each guidepost (223) has a distal end.

The battery compartment hole is formed through the cover toward an end of the cover (22) away from the push button hole (221).

The latches (222) are formed on and protrude out from the rear surface of the cover (22) respectively near the two sides and correspond to and engage the notches (212) in the housing (21) to hold the cover (22) securely on the housing (21).

The battery compartment (23) is mounted on the rear surface of the cover (22), corresponds to the battery compartment hole through the cover (22), holds a battery (231) and has a battery compartment cover (232).

The battery compartment cover (232) is mounted in the battery compartment hole flush with the cover (22) to close the battery compartment (23) and has an optional fingernail recess (2320) to allow a person to easily remove the battery compartment cover (232) and then replace the battery (231).

The push button (24) is mounted slidably in and protrudes out from the push button hole (221) in the cover (22) and has a cap (241), an electrical pad (245), a metallic plug (247) and a resilient member (246).

The cap (241) is hollow, is slidably mounted in the push button hole (221) in the cover (22) and has a closed outer end, an open inner end, a neck (242) and two tabs (243). The closed outer end has an outer surface and an inner surface.

The neck (242) is formed on and protrudes from the inner surface of the cap (241) and has a distal end.

The two tabs (243) are formed on and protrude from the inner surface of the closed outer end of the cap (241) respectively on opposite sides of the neck (243), and each tab (243) has a distal end and a hook (2430). The distal ends of the tabs (243) are mounted slidably between two guideposts (223). The hooks (2430) are defined respectively on the ends of the tab (243) and hook the edge of the push button hole (221) in the cover (21) to keep the push button (24) from sliding out of the push button hole (221).

The electrical pad (245) is mounted on the distal ends of the guideposts (223) and has a through hole (2450).

Figure 6:
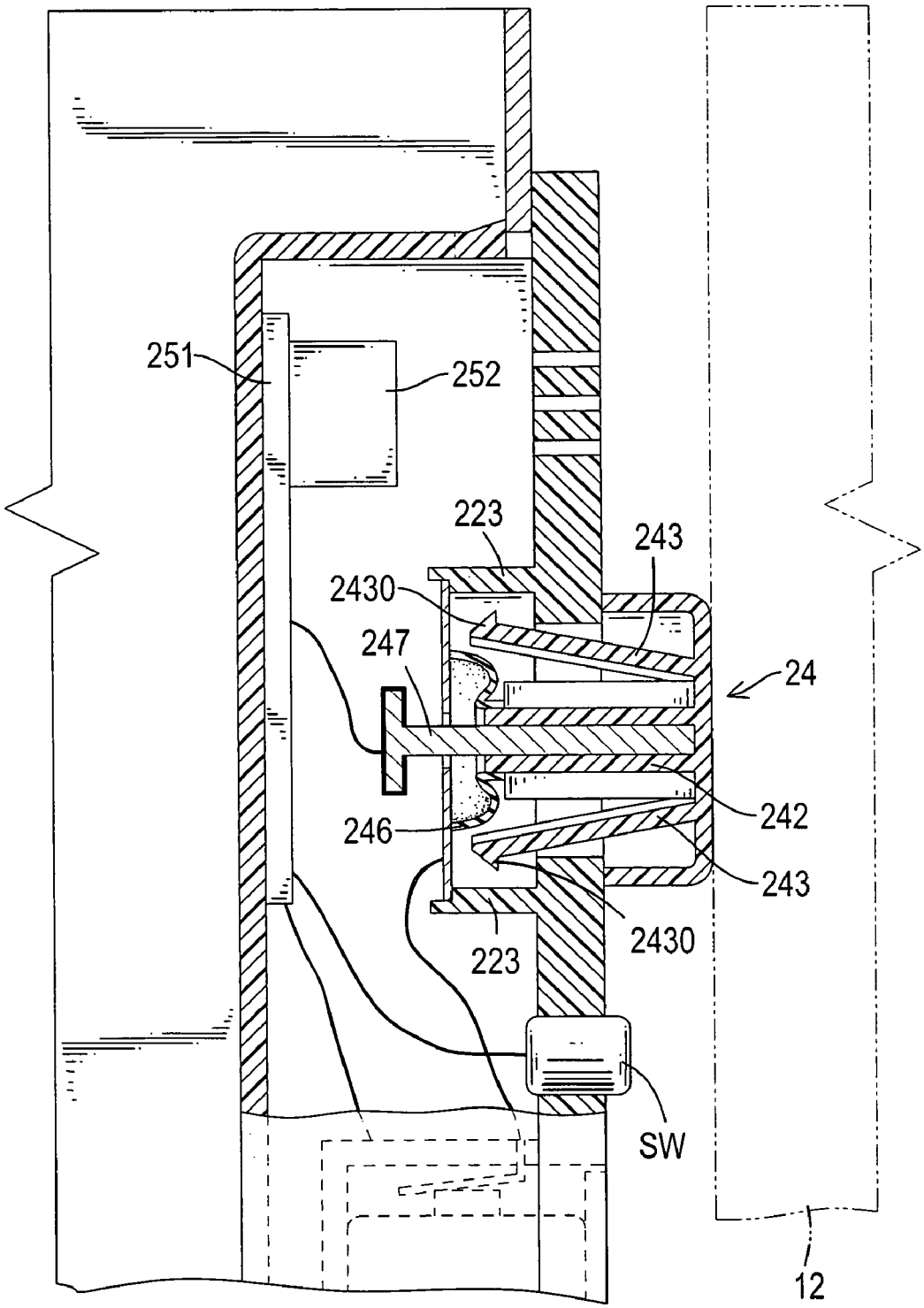
FIG. 6 is an enlarged operational side view in partial section of the door alarm system in FIG. 1 with the push button depressed.

The metallic plug (247) is mounted through the through hole in the electrical pad (245), is mounted in and protrudes from the distal end of the neck (242), selectively presses against the electrical pad (245) and has a distal end and a head. With further reference to FIG. 6, the head is formed on the distal end of the metallic plug (247), is larger than the through hole (2450) in the electrical pad (245) and selectively presses against the electrical pad (245). When the door body (12) closes and presses against the cap (241), the head of the metallic plug (247) is pressed away and disconnects from the electrical pad (245).

The resilient member (246) is mounted around the metallic plug (247) between the neck (243) and the electrical pad (245) to press the push button (24) out of the push button hole (221) and cause the metallic plug (247) to press against the electrical pad (245).

The controller (25) is mounted in the housing (21), selectively activates and deactivates the door alarm device (20) when the metallic plug (24) respectively presses against and disconnects from the electrical pad (245) and comprises a circuit board (251), an audio unit (252) and power source (not numbered).

The circuit board (251) is mounted in the housing (21) and is connected electrically to the metallic plug (247).

Figure 7:
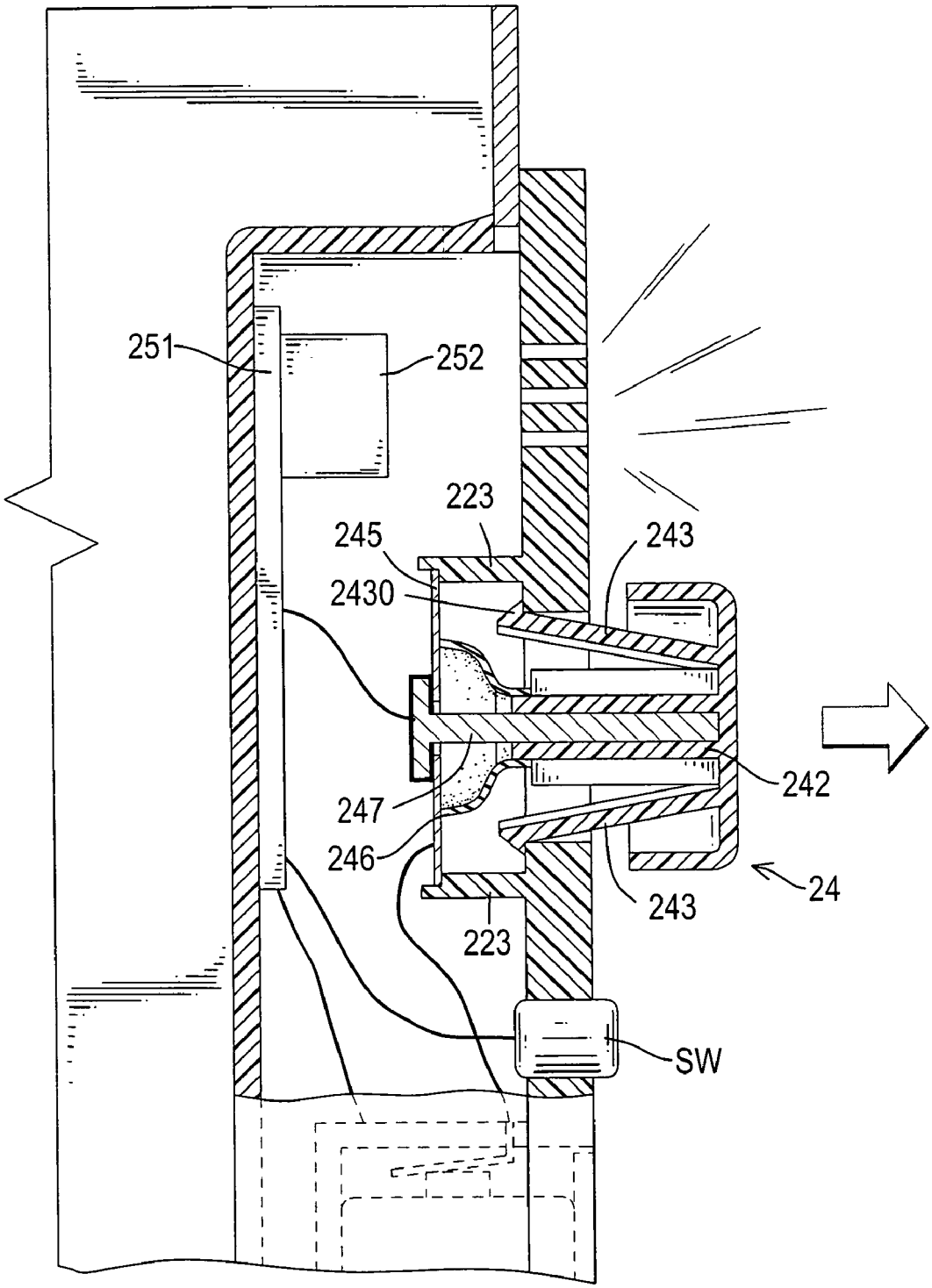
FIG. 7 is an enlarged operational side view in partial section of the door alarm system in FIG. 1 with the push button released.

With reference to FIG. 7, an embodiment of the audio unit (252) is mounted in the housing (21), is connected electrically to the circuit board (251) and has an audio IC (IC) and a buzzer (BZ) connected to the audio IC (IC) and the power source. The audio IC (IC) stores a warning signal. The audio IC (IC) outputs the warning signal to the buzzer (BZ) to emit an audible warning when the door body (12) is open and the metallic plug (247) presses against the electrical pad (245).

Figure 8:
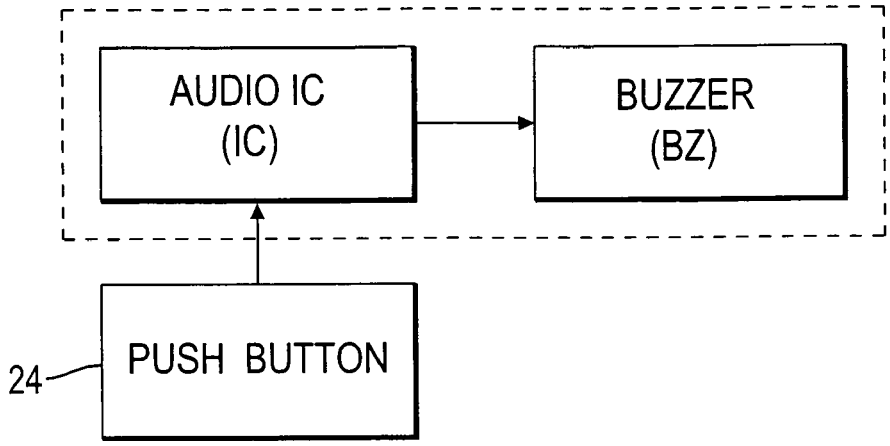
FIG. 8 is a block diagram of a first embodiment of a controller in accordance with the present invention.
Figure 9:
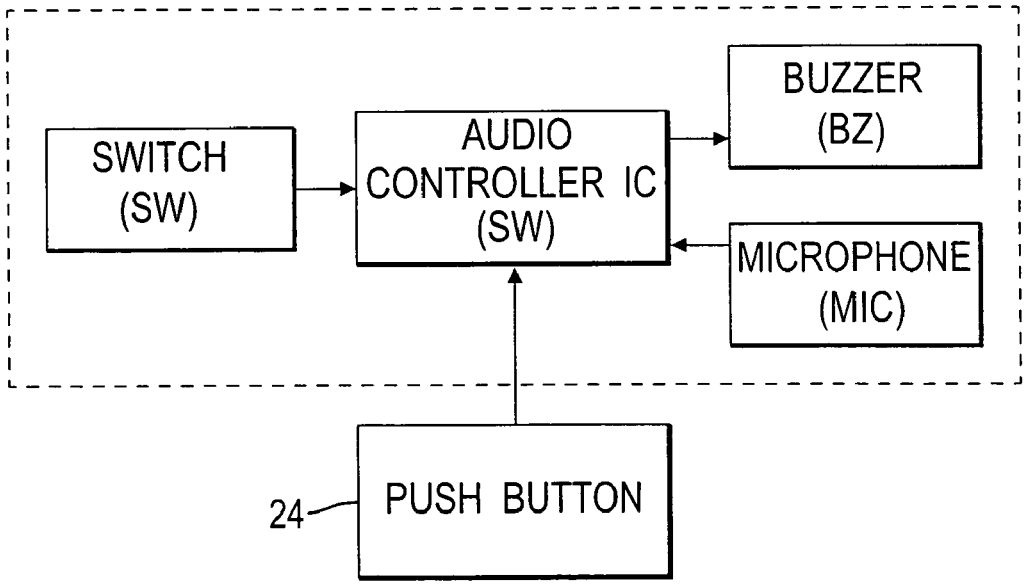
FIG. 9 is a block diagram of a second embodiment of an audio unit in accordance with the present invention.

With further reference to FIG. 8, another embodiment of the audio has an audio controller IC (IC1), a buzzer (BZ), a microphone (MIC), and a switch (SW). The audio controller IC (IC1) is connected electrically to the buzzer (BZ), the microphone (MIC), the switch (SW), the power source and the push button (24). With reference to FIGS. 4 to 7 and 9, the switch (SW) is mounted on the cover (22), located below the push button (24) on the cover (22) and connected electrically to the circuit board (251). A user touches the switch (SW) to select a recording function of the audio controller IC (IC1) and then speaks to the microphone (MIC) to record his or her audio signal or music signal. Further, the user also touches the switch (SW) to remove audio signal or music signal. The microphone (MIC) transmits the user's audio signal or music signal to the audio controller IC (IC1) to store. When the door body (12) is open and the metallic plug (247) presses against the electrical pad (245), the audio controller IC (IC1) detects the door being in opened condition by the push button (24). At the time, the audio controller IC (IC1) outputs the recorded user's audio signal or music signal to the buzzer (BZ). Therefore, the buzzer (BZ) broadcasts the user's audio signal or music when the door body (12) is opened. Therefore, the user could record massage in the audio controller IC to remind the user before the user leaves the house.

The audio signal may be an audible warning, reminding or music. The switch may be mounted on the cover (22).

The power source has a set of electrodes, is connected electrically to the circuit board (251) through the electrical pad (245) to supply electricity to the door alarm device (20) and is implemented with a battery (231) mounted in the battery compartment (23).

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A door alarm system comprising:

a door having a doorframe; and a door body mounted pivotally in the doorframe and having a proximal edge attached pivotally to the doorframe; and at least one hinge attached to the proximal edge of the door body and the doorframe;

a door alarm device mounted on the door and comprising:

a housing having a top;

a bottom;

an upper edge;

a lower edge;

two sides;

an open front;

two clamps formed respectively on the upper edge and the lower edge of the housing, protruding out respectively from the top and bottom and hook respectively the door; and two notches formed respectively on the two sides of the housing;

a cover mounted detachedly on and closes the open front of the housing and having two ends;

a rear surface;

two sides;

a push button hole formed through the cover near one end of the cover and having an edge;

four guideposts formed on and protruding from the rear surface of the cover at the edge of the push button hole of the cover, and each guidepost having a distal end;

a battery compartment hole is formed through the cover toward an end of the cover away from the push button hole; and two latches formed on and protruding out from the rear surface of the cover respectively near the two sides of the cover and corresponding to and engaging the notches in the housing;

a battery compartment mounted on the rear surface of the cover, corresponding to the battery compartment hole through the cover and having a battery compartment cover mounted in the batter compartment hole flush with the cover;

a push button mounted slidably in and protruding out from the push button hole of the cover and having a cap being hollow, slidably mounted in the push button hole in the cover and having a closed outer end having an outer surface; and an inner surface;

an open inner end;

a neck formed on and protruding from the inner surface of the cap and having a distal end; and two tabs formed on and protruding from the inner surface of the closed outer end of the cap respectively on opposite sides of the neck, and each tab having a distal end mounted slidably between two guideposts; and a hook defined on the end of the tab and hooking the edge of the push button hole in the cover;

an electrical pad mounted on the distal ends of the guideposts and having a through hole;

a metallic plug mounted through the through hole in the electrical pad, mounted in and protruding from the distal end of the neck, selectively presses against the electrical pad and has a distal end; and a head formed on the distal end of the metallic plug, being larger than the through hole in the electrical pad and selectively pressing against the electrical pad;

a resilient member mounted around the metallic plug between the neck and the electrical pad to press the push button out of the push button hole and cause the metallic plug to press against the electrical pad;

a controller mounted in the housing, selectively activating and deactivating the door alarm device and having a circuit board mounted in the housing and being connected electrically to the metallic plus;

a audio unit mounted in the housing, connected electrically to the circuit board and emitting an audible warning when the door body is open;

a power source connected electrically to the circuit board through the electrical pad to supply electricity to the door alarm device.

2. The door alarm system as claimed in claim 1, wherein the audio unit has a buzzer and an audio IC connected electrically to the buzzer, the push button and the power source.

3. The door alarm system as claimed in claim 1, wherein the audio unit comprises:

an audio controller IC connected electrically to the push button and the power source and having a recording and broadcasting audio signal functions;

a buzzer connected to an output of the audio controller IC to broadcasting audio signal from the audio controller IC;

a microphone connected electrically to an input of the audio controller IC and the power source; and a switch mounted on the cover, connected electrically to the audio controller IC and the power source to select the recording audio signal function.

4. The door alarm system as claimed in claim 1, wherein the battery compartment cover further comprises a fingernail recess.

5. The door alarm system as claimed in claim 1, further comprising a recess defined in the doorframe, adjacent to the proximal edge of the door body and having an upper edge and a lower edge.

6. The door alarm system as claimed in claim 5, wherein the door alarm device is mounted in the recess of the doorframe and the two clamps of the housing of the door alarm device respectively hook on the upper and lower edges of the recess in the doorframe.

7. The door alarm system as claimed in claim 1, further comprising a recess defined in the door body, adjacent to the doorframe and having an upper edge and a lower edge.

8. The door alarm system as claimed in claim 7, wherein the door alarm device is mounted in the recess of the door body and the two clamps of the housing of the door alarm device respectively hook on the upper and lower edges of the recess in the door body.

* * * * *